US005558547A

United States Patent [19]

Breitschaft et al.

[11] Patent Number: 5,558,547

[45] Date of Patent: Sep. 24, 1996

[54] CONTACT SPRING HAVING A DETENT SLEEVE CONSTRUCTED AS AN OVERSPRING

[75] Inventors: Josef Breitschaft, Prien, Germany; Jacques De Pauw, Damme-Swsele, Belgium; Artur Wohlfart, Bad Dürkheim, Germany

[73] Assignee: Siemens Aktiengesellschaft, Munich, Germany

[21] Appl. No.: 293,827

[22] Filed: Aug. 22, 1994

Related U.S. Application Data

[63] Continuation of PCT/DE92/00776, Sep. 14, 1992.

[30] Foreign Application Priority Data

Feb. 24, 1992 [DE] Germany ..... 9202366 U

[51] Int. Cl.[6] ..... H01R 13/187

[52] U.S. Cl. ..... 439/843; 439/816; 439/856; 439/862

[58] Field of Search ..... 439/842–848, 439/816, 834, 851, 852, 856, 862

[56] References Cited

U.S. PATENT DOCUMENTS

| | | | |
|---|---|---|---|
| 4,550,972 | 11/1985 | Romak | 439/843 |
| 4,712,299 | 12/1987 | Loewen et al. | 439/816 |
| 5,108,318 | 4/1992 | Sakurai | 439/843 |

FOREIGN PATENT DOCUMENTS 3546762 1/1991 Germany .

*Primary Examiner*—P. Austin Bradley
*Assistant Examiner*—Jill Demello
*Attorney, Agent, or Firm*—Herbert L. Lerner; Laurence A. Greenberg

[57] ABSTRACT

A contact spring assembly includes a contact spring having a connection part for an electrical conductor and a contact part with a spring leg base and spring legs originating therefrom for contacting a plug contact. A detent sleeve is retained at the spring leg base, produced from sheet metal as a stamped and bent part, surrounds the contact part like a box and constructed as an overspring. The detent sleeve has a bottom wall, two side walls each having an overspring arm being cut out of the side wall, bent inward and resting on a respective one of the spring legs, a top wall being divided by a longitudinal slit, and a detent spring arm being cut out of one of the walls, extending in the longitudinal direction of the detent sleeve and being bent outward. The overspring arms are formed solely by dividing cuts extending substantially crosswise to a longitudinal direction of the detent sleeve. The dividing cuts converge from the side walls toward a longitudinal edge region at a transition to the bottom wall and end there with the respective overspring arm remaining connected to the detent sleeve in a longitudinal edge region. The respective overspring arm extends from a connection location crosswise to the longitudinal direction of the detent sleeve, is bent inward about a bending line located in the longitudinal edge region and extends parallel to the longitudinal direction and in the direction of the longitudinal direction of the detent sleeve.

12 Claims, 4 Drawing Sheets

CONTACT SPRING HAVING A DETENT SLEEVE CONSTRUCTED AS AN OVERSPRING

CROSS-REFERENCE TO RELATED APPLICATIONS

This application is a Continuation of International Application Ser. No. PCT/DE92/00776, filed Sep. 14, 1992.

BACKGROUND OF THE INVENTION

Field of the Invention

The invention relates to a contact spring with a connection part for an electrical conductor and a contact part with a spring leg base and spring legs originating there for contacting a plug contact, and a detent sleeve retained at the spring leg base, produced from sheet metal as a stamped and bent part, surrounding the contact part in boxlike fashion and being constructed as an overspring, the detent sleeve having a bottom wall, two side walls each having one overspring arm cut out of the side wall, bent inward and resting on a respective spring leg, a top wall divided by a production-dictated longitudinal slit, and a detent spring arm being cut out of a wall, extending longitudinally of the detent sleeve and being bent outward.

Such contact springs are well known, for instance from German Patent DE 35 46 762 C2. In such contact springs, the detent sleeve essentially serves the function of a reinforcement spring or overspring that is intended to increase the spring force. To that end, the overspring known from German Patent DE 35 46 762 C2 is provided on both side walls with cutouts, each in the longitudinal edge region of the box shape, and with dividing cuts on a front rib of the box, so that overspring arms are formed which extend forward in tongue-like fashion toward the plug-side end. They are bent inward toward one another and rest on the contact spring. A detent spring arm is also cut away from the bottom wall of the overspring and bent outward. It serves to lock the contact spring in the contact chamber of a housing. However, the stability of the overspring and therefore its protective function can be impaired if there is a relatively large number of cutouts provided in the walls of an overspring.

SUMMARY OF THE INVENTION

It is accordingly an object of the invention to provide a contact spring having a detent sleeve constructed as an overspring, which overcomes the hereinafore-mentioned disadvantages of the heretofore-known devices of this general type and in which the detent sleeve constructed as an overspring reinforces the spring force, while avoiding impairment of its protective function as much as possible.

With the foregoing and other objects in view there is provided, in accordance with the invention, a contact spring assembly, comprising a contact spring having a connection part for an electrical conductor and a contact part with a spring leg base and spring legs originating from the spring leg base for contacting a plug contact; and a detent sleeve being retained at the spring leg base, being produced from sheet metal as a stamped and bent part, surrounding the contact part like a box, being constructed as an overspring and having a longitudinal direction and a longitudinal edge region, the detent sleeve having a bottom wall, two side walls each having an overspring arm being cut out of the side wall, bent inward and resting on a respective one of the spring legs, a transition to the bottom wall, a top wall being divided by a production-dictated longitudinal slit formed therein, and a detent spring arm being cut out of one of the walls, extending in the longitudinal direction of the detent sleeve and being bent outward; the overspring arms being formed solely by dividing cuts extending substantially crosswise to a longitudinal direction of the detent sleeve; the dividing cuts converging from the side walls toward the longitudinal edge region at the transition to the bottom wall and ending there with the respective overspring arm remaining connected to the detent sleeve at a connection location in the longitudinal edge region; and the respective overspring arm extending from the connection location crosswise to the longitudinal direction of the detent sleeve, being bent inward about a bending line located in the longitudinal edge region and extending parallel to the longitudinal direction and in the direction of the longitudinal direction of the detent sleeve.

In such a contact spring, the overspring arms of the detent sleeve are formed merely by dividing cuts, so that the detent sleeve is not mechanically weakened and optically opened by cutouts but rather is given a boxlike profile that is closed to the maximum possible extent. The contact spring is accordingly well protected against damage, for instance from pointed tools, by the detent sleeve. Moreover, the closed profile results in a mechanically stable detent sleeve, which is especially significant for protecting a contact spring and detent sleeve unit that has not yet been accommodated in a contact chamber of a housing and is still exposed to the rough circumstances of factory operation. The great dimensional stability of the detent sleeve achieved by the closed boxlike profile lends the detent sleeve greater load-bearing capacity in different directions. In other words, in comparison with a detent sleeve that is more open because of cutouts and therefore has less load-bearing capacity, the closed detent sleeve is torsionally more rigid and absorbs more forces. Despite this closed boxlike profile, in a contact spring according to the invention, because of the advantageous disposition of the overspring arms, optimal spring force reinforcement is attained. Since the overspring arms are merely formed by dividing cuts but remain connected to the detent sleeve in the longitudinal edge region, or in other words in the direction of the width of a side wall of the detent sleeve, they extend crosswise to the longitudinal direction thereof, the overspring base is formed at the line of bending out of the stable bottom region, so that defined spring ratios are attained. With this kind of disposition of the overspring arms, there is also enough space for the embodiment of an overspring arm and therefore for dimensioning the spring force, since the width of the base of the overspring arms is not impaired for constructional reason and can be extended to an adequate extent between the plug-side end and the connection-side end of the detent sleeve. Conversely, if the overspring arms extend in the longitudinal direction of the detent sleeve, then the maximal width of the base of the overspring arms is limited by the maximum width of a side wall of the detent sleeve.

In accordance with another feature of the invention, in order to form an overspring arm, there is provided a longer dividing cut, which is oriented perpendicular to the longitudinal direction of the detent sleeve and extends to near the longitudinal edge at the transition from the respective side wall to the top wall; a relatively short dividing cut, farther away from the plug-side end of the detent sleeve than the longer dividing cut, which cut is likewise oriented perpendicular to the longitudinal direction of the detent sleeve and parallel to the longer dividing cut and reaches only partway into the respective side wall; and a third dividing cut joining these two dividing cuts to one another on their ends, the third dividing cut is disposed solely in the respective side wall of the detent sleeve and extends obliquely to the longitudinal direction of the detent sleeve. In this way, overspring arms are created in which the force engagement in terms of height can be optimally adapted to the spring legs of the contact spring by means of the disposition, construction and position. The oblique dividing cut, on the forward-bent spring arms, suitably forms a kind of run-up incline for better installation of the contact spring in the detent sleeve.

In accordance with again another feature of the invention, the detent sleeve has a longitudinal edge, and the first and second long and short dividing cuts forming the overspring arms extend partway around the longitudinal edge and end in the bottom wall.

In accordance with again a further feature of the invention, each overspring arm has a shape similar in outline to a right triangle.

In accordance with again an added feature of the invention, there is provided a transition from the first longer dividing cut to the third oblique dividing cut being formed by a radius.

In accordance with a further feature of the invention, each overspring arm has a perforation. Fine adjustment of the spring force can be attained by a perforation in the overspring arms. The size, position and shape of the perforation influence the force and travel conditions of the overspring arms.

In accordance with an added feature of the invention, with a view toward the metering or dosing of the contact force, it is advantageous if the perforation is disposed in the longitudinal edge region. A favorable effect on the force and travel conditions can then be exerted. Conversely, by forming the perforation solely in the side wall, more influence can be exerted on the bending line.

In accordance with yet another feature of the invention, the perforation extends both partway into the respective side wall and partway into the bottom wall.

In accordance with yet a further feature of the invention, the overspring arm has a base with a width having a center, and the perforation is formed approximately in the center of the width of the base.

In accordance with yet an added feature of the invention, the perforation is formed solely in the side wall.

In accordance with an additional feature of the invention, one spring leg of the contact spring, on a longitudinal edge oriented toward the bottom wall of the detent sleeve, is constructed with a tab, as a spring preopening contour, that is torn out in the direction of the other spring leg. One particular advantage of this embodiment is that the contact-reinforcing action of the overspring arms takes place on the side opposite the spring preopening contour. In other words, the force engagement of the overspring arms on the spring legs of the contact spring takes place suitably at a point where the spring legs are generally usually spread somewhat apart.

In accordance with a concomitant feature of the invention, with a view toward avoiding additional cutouts and with a view toward stability of the detent sleeve, it is advantageous if the longitudinal slit in the top wall of the detent sleeve extends eccentrically with respect to the width thereof, so that the top wall is divided into a narrow portion and a wide portion, and the detent spring arm is provided in the wide portion. Thus the detent spring arm is disposed on the top wall, which is open anyway, and therefore no further walls in the detent sleeve have to be cut out for the detent spring arm.

Other features which are considered as characteristic for the invention are set forth in the appended claims.

Although the invention is illustrated and described herein as embodied in a contact spring having a detent sleeve constructed as an overspring, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
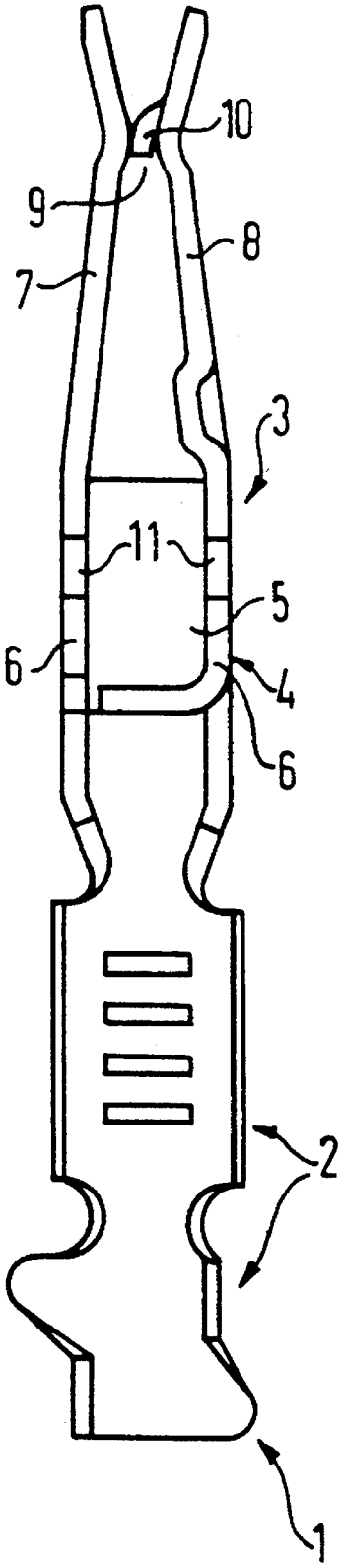
FIG. 1 is a diagrammatic plan view of a contact spring.
Figure 2:
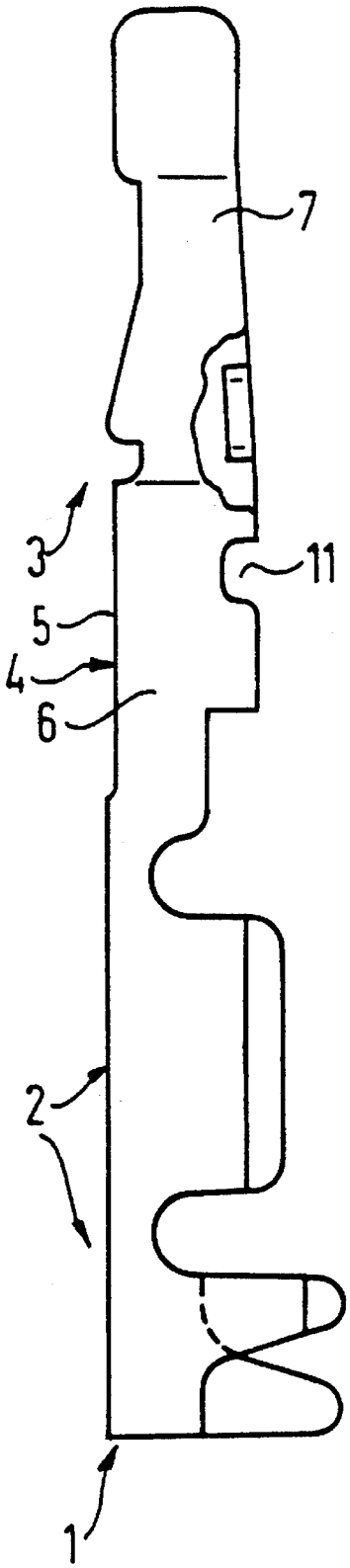
FIG. 2 is a side-elevational view of the contact spring.

Referring now to the figures of the drawing in detail and first, particularly, to FIGS. 1 and 2 thereof, there is seen a contact spring 1 which includes a connection part 2 that is constructed as a crimp connection, for instance, which is adjoined by a contact part 3 with a spring leg base 4 having a U-shaped cross section, that has a bottom 5 and two side walls 6. The contact part 3 has two spring legs 7 and 8 as its plug-side extension of these side walls, for contacting a plug contact. Beginning at the spring leg base 4, these spring legs 7, 8 initially extend toward one another up to a contact zone 9, at which one spring leg 8 is constructed on one long edge with tabs 10 as a spring preopening contour, and the tabs are torn out in the direction of the other spring leg 7. Beyond this contact zone 9, the spring legs 7 and 8 extend away from one another in funnel-like fashion. The two side walls 6 of the spring leg base 4 are each constructed with a recess 11 formed in a free long side facing toward the observer in FIG. 1, for a later fixation of a detent sleeve.

Figure 6:
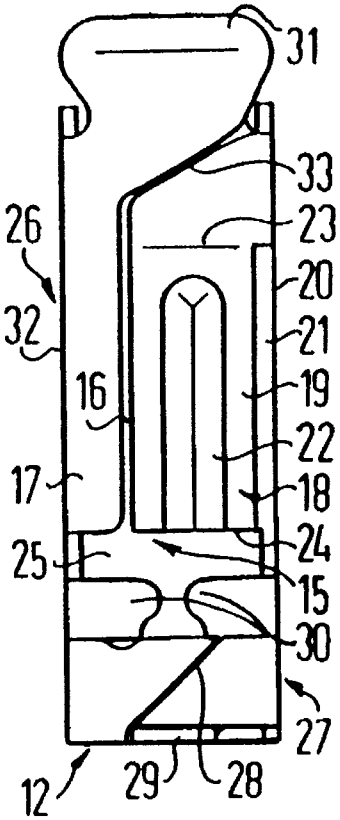
FIGS. 3–6 are four elevational views of sides of a detent sleeve.
Figure 5:
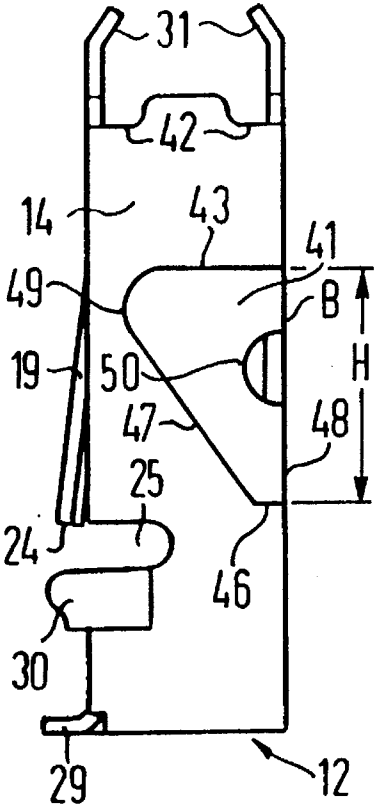
Figure 4:
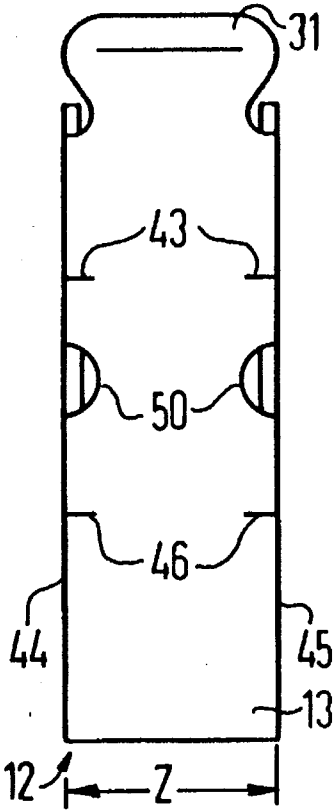
Figure 3:
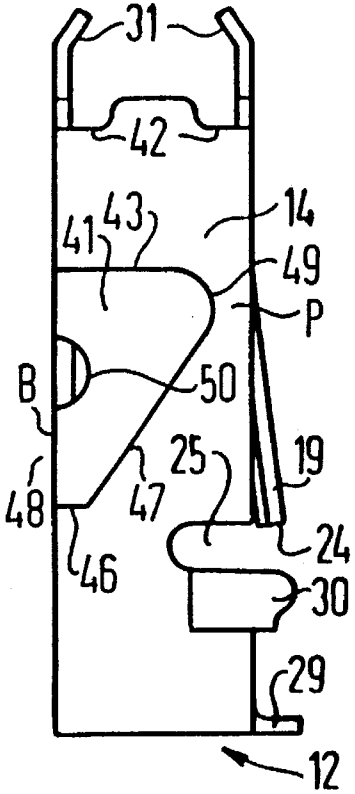

A detent sleeve 12 which is shown in FIGS. 3–6 is made of sheet metal from a stamped and bent part and is shaped into a part of rectangular cross section with a bottom wall 13, two side walls 14 and a top wall 15. The top wall 15 is divided by a longitudinal slit 16 for production reasons. FIGS. 3 and 5 show elevation views of the two side walls 14, while FIG. 4 shows an elevation view of the bottom wall 13 and FIG. 6 shows an elevation view of the top wall 15 of the detent sleeve 12. It can be seen in FIG. 6 that the longitudinal slit 16 in the top wall extends eccentrically in terms of the width thereof, so that the top wall 15 is divided into a narrow portion 17 and a wide portion 18. In the exemplary embodiment shown, the wide portion 18 is approximately twice as wide as the narrow portion 17. A detent spring arm 19 extending longitudinally of the detent sleeve 12 is provided in the wide portion 18 of the top wall 15. This arm serves to lock the contact spring and detent sleeve unit in a contact chamber of a housing. The arm 19 is cut out of the wide portion 18 and is bent outward at the bending line 23, as can be seen from FIGS. 3, 5 and 6. Suitably, the width of the detent spring arm is equal to the full width of the wide portion 18 of the top wall 15, so that in its width, the detent spring arm 19 extends from the longitudinal slit 16 as far as a long edge 20 of the detent sleeve 12 at a transition from the top wall 15 to the right-hand side wall 14. Thus only one dividing cut 21, which is located in the longitudinal edge 20, is provided on the long sides of the detent spring arm 19. The detent spring arm 19 is constructed with a bead 22 that is impressed inward. The bead 22 begins somewhat below the bending line 23 and extends centrally in the longitudinal direction of the detent spring arm 19 as far as a free end surface 24 thereof. On one hand in order to form this free end surface 24 and on the other hand in order to form means for fixing the detent sleeve 12 to the contact spring 1, the top wall 15 of the detent sleeve 12 has a cutout 25 extending in a small region which is oriented toward the spring leg base 4 of the contact spring 1, near the end of the contact spring 1 facing toward the connection part 2, and extending over the entire width of the top wall 15. This cutout subdivides the top wall 15 into a protective zone 26 that surrounds the spring legs 7, 8 of the contact spring 1 in boxlike fashion, and a production-dictated slit bearing zone 27 that fits around the spring leg base 4 in boxlike fashion. A slit 28 in the bearing zone 27 is suitably oriented obliquely to the longitudinal direction of the detent sleeve 12, which is especially advantageous with respect to minimizing the gap width when a weld spot is made by laser welding in order to improve the stability of the detent sleeve. Finally, a narrow rib 29 that is bent outward by approximately 90° is also provided on an end of the bearing zone 27 which is oriented toward the connection part 2 of the contact spring 1. The rib 29 assures positionally correct insertion of the contact spring and detent sleeve unit into a contact chamber of a housing. Upon making the cutout 25, which also extends a slight distance into the side walls 14, a retaining tab 30 is formed in each of the side walls 14 in the region between the protective zone 26 and the bearing zone 27. Each tab 30 can be fixed in the respective recesses 11 of the spring leg base 4 by being bent away from the side wall 14. Finally, free ends of the top wall 15 and the bottom wall 13 of the detent sleeve 12 are each provided toward the plug with a guide and protection tab 31 that is bent somewhat inward. In that case, the longitudinal slit 16, which extends from the cutout 25 between the protective zone 26 and the bearing zone 27 in the direction of the guide and protection tab 31, parallel to the longitudinal edges 20, 32 of the detent sleeve 12, is bent just below the guide and protection tab 31 obliquely relative to the longitudinal edges 20, 32, and then extends to the plug-side end of the detent sleeve 12 as far as its longitudinal edge 20, in which the dividing cut 21 is located that forms the detent spring arm 19. A bend 33 in the longitudinal slit 16 is again advantageous in view of the provision of a weld spot in the region of the longitudinal slit.

Figure 8:
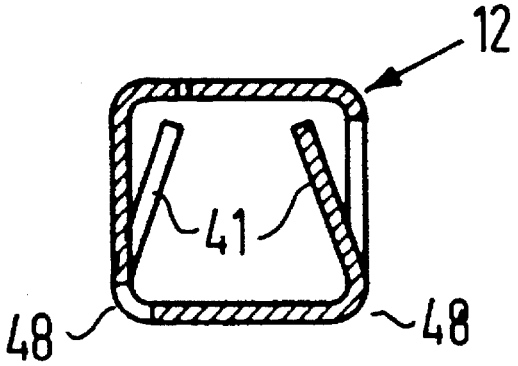
FIG. 8 is a cross-sectional view of the detent sleeve.
Figure 7:
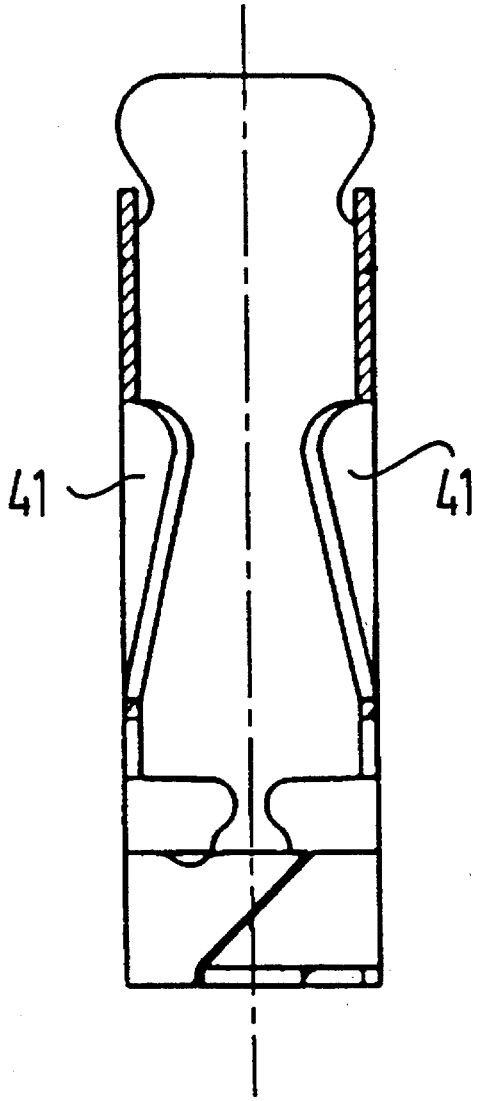
FIG. 7 is a partly longitudinal-sectional view of the detent sleeve of FIG. 6.
Figure 9:
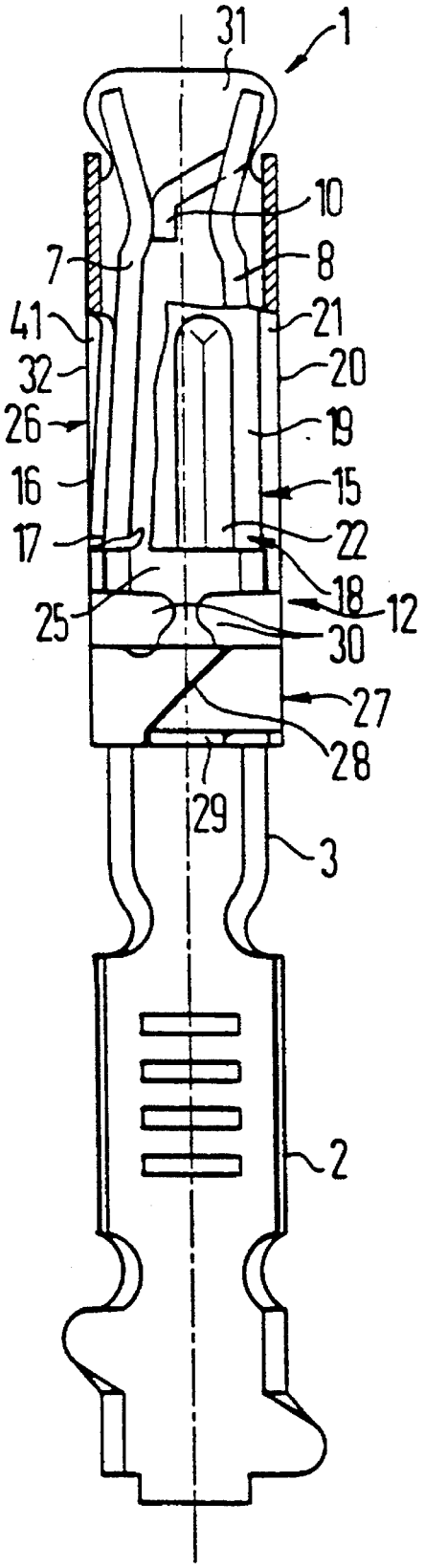
FIGS. 9 and 10 are respective plan and side-elevational views of a contact spring and detent sleeve unit.
Figure 10:
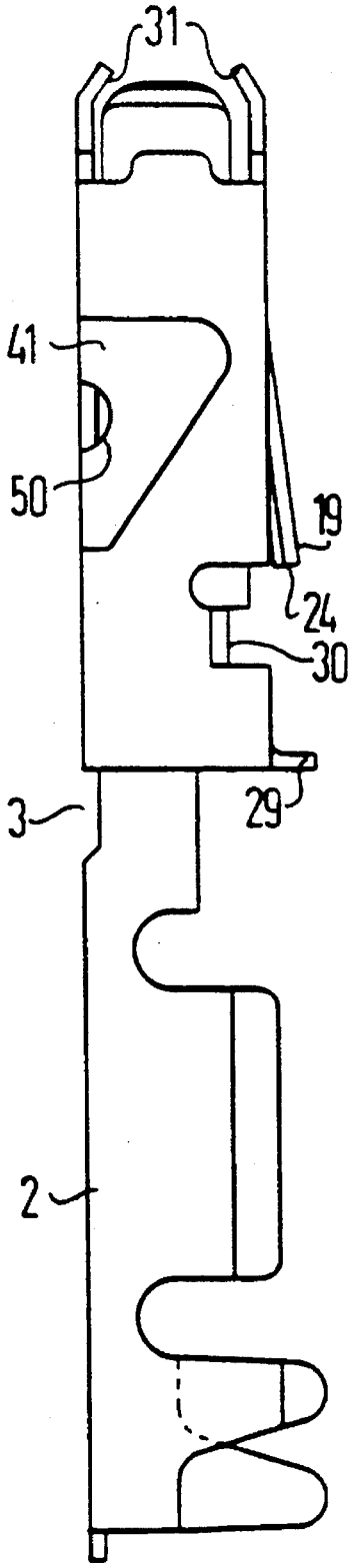

As is seen particularly in FIGS. 3 and 5, in the side views of FIGS. 7 and 8 and in FIGS. 9 and 10, the detent sleeve 12 is constructed as an overspring or cap spring for reinforcing the spring force. To that end, one overspring arm 41 is cutout of each side wall 14 and bent inward. As the drawings clearly show, the two overspring arms 41 are disposed, constructed and produced in the same way, and are disposed symmetrically in the side walls 14 with respect to the center longitudinal axis of the detent sleeve or its bottom wall 13. The overspring arms 14 are formed merely by dividing cuts, which extend essentially transversely to the longitudinal direction of the detent sleeve 12. In the embodiment shown, the overspring arms 41 are disposed within the protection zone 26 and are spaced apart from a plug-side edge 42 of the detent sleeve 12. In order to form an overspring arm 41, a first longer dividing cut 43 which is provided in this case is oriented perpendicular to the longitudinal direction of the detent sleeve 12. On one end, the first longer dividing cut 43 extends to a location near the longitudinal edge 20 or 32 at the transition from the respective side wall 14 to the top wall 15, and on the other end it is extended around a respective rear longitudinal edge 44 and 45 and ends in the bottom wall 13, as can be seen in FIG. 4. A second, relatively shorter dividing cut 46, which is even farther from the plug-side end of the detent sleeve 12 than the longer dividing cut 43, and which likewise is oriented perpendicular to the longitudinal direction of the detent sleeve and parallel to the longer dividing cut, is also provided, but it is extended only partway around the rear longitudinal edge 44 and 45 into the bottom wall 13 and the respective side wall 14. Furthermore, a third dividing cut 47, which extends obliquely relative to the longitudinal direction of the detent sleeve 12, is provided solely in the respective side wall 14 and joins the two dividing cuts 43 and 46 together at their ends. Thus the overspring arms 41 are formed with a basic outline similar to a right triangle. The dividing cuts 43, 46 and 47 converge from the side walls 14 toward the longitudinal edge region at the transition to the bottom wall 13 and end there in such a way that the respective overspring arm 41 remains connected to the detent sleeve 12 in this longitudinal edge region. Each overspring arm 41 extending from this connection location toward the front longitudinal edge 20 or 32, crosswise relative to the longitudinal direction of the detent sleeve in the direction of a detent sleeve width Z, is then bent inward about a bending line 48 (FIGS. 3, 5 and 8) being located in the rear longitudinal edge region and extending parallel to the longitudinal direction and in the direction of the longitudinal direction of the detent sleeve. This bending line 48 forms an overspring base B with a base width H. As will be readily apparent, since after all this base width extends in the longitudinal direction of the detent sleeve, it is not limited structurally to the detent sleeve width Z. A radius 49 is formed at a transition from the longer dividing cut 43 to the oblique dividing cut 47, and a force engagement P of the overspring arms 41 optimally takes place with the radius 49 at the spring legs 7, 8 of the contact spring 1, and specifically eccentrically, with respect to the center axis, at the spring legs and advantageously in a region opposite the tabs 10 of the spring leg 8. This is also clear from FIG. 9. The oblique dividing cut 47 simultaneously also serves as a runup incline when the contact spring is inserted into the detent sleeve. In order to adjust or meter the contact force, each overspring arm 41 has a perforation 50, which in this case is disposed in the rear longitudinal edge region, approximately in the middle of the base width H of an overspring arm 41, and extends both into the respective side wall 14 and some distance into the bottom wall 13.

The illustrated detent sleeve 12 that is made of chromium-nickel steel, for instance, is closed to the maximum extent and thus is very stable in structure and is advantageously used particularly where in addition to a protective and locking function of the detent sleeve, a force-reinforcing action of the contact spring by overspring arms is especially important, as is the case with contacts made of tin with a relatively high contact force.

We claim:

1. A contact spring assembly, comprising:

a contact spring having a connection part for an electrical conductor and a contact part with a spring leg base and spring legs originating from said spring leg base for contacting a plug contact; and a detent sleeve being retained at said spring leg base, being produced from sheet metal as a stamped and bent part, surrounding said contact part like a box, being constructed as an overspring and having a longitudinal direction and a longitudinal edge region, said detent sleeve having a bottom wall, two side walls each having an overspring arm being cut out of said side wall, bent inward and resting on a respective one of said spring legs, a transition to said bottom wall, a top wall being divided by a production-dictated longitudinal slit formed therein, and a detent spring arm being cut out of one of said walls, extending in said longitudinal direction of said detent sleeve and being bent outward;

said overspring arms being formed solely by dividing cuts extending substantially crosswise to said longitudinal direction of said detent sleeve; said dividing cuts converging from said side walls toward said longitudinal edge region at said transition to said bottom wall and ending there with said respective overspring arm remaining connected to said detent sleeve at a connection location in said longitudinal edge region; and said respective overspring arm extending from said connection location crosswise to said longitudinal direction of said detent sleeve, being bent inward about a bending line located in said longitudinal edge region and extending parallel to said longitudinal direction and in the direction of said longitudinal direction of said detent sleeve.

2. The contact spring assembly according to claim 1, wherein one of said spring legs of said contact spring has a longitudinal edge oriented toward said bottom wall of said detent sleeve with a tab as a spring preopening contour being torn out in the direction of the other of said spring legs.

3. The contact spring assembly according to claim 1, wherein said longitudinal slit in said top wall of said detent sleeve extends eccentrically relative to the width of said top wall, dividing said top wall into a narrow portion and a wide portion with said detent spring arm being formed in said wide portion.

4. The contact spring assembly according to claim 1, wherein said dividing cuts forming said overspring arms include:

a first longer dividing cut being oriented perpendicular to said longitudinal direction of said detent sleeve and extending near to said longitudinal edge region at a transition from said respective side wall to said top wall;

a second relatively short dividing cut disposed farther away from a plug-side end of said detent sleeve than said first longer dividing cut, said second relatively short dividing cut also being oriented perpendicular to said longitudinal direction of said detent sleeve and parallel to said first longer dividing cut and reaching only partway into said respective side wall; and a third dividing cut joining ends of said first and second dividing cuts to one another, said third dividing cut being disposed solely in said respective side wall of said detent sleeve and extending obliquely to said longitudinal direction of said detent sleeve.

5. The contact spring assembly according to claim 4, wherein said detent sleeve has a longitudinal edge, and said first and second long and short dividing cuts forming said overspring arms extend partway around said longitudinal edge and end in said bottom wall.

6. The contact spring assembly according to claim 5, wherein each overspring arm has an outline substantially corresponding to a right triangle.

7. The contact spring assembly according to claim 5, including a transition from said first longer dividing cut to said third oblique dividing cut being formed by a radius.

8. The contact spring assembly according to claim 5, wherein each overspring arm has a perforation formed therein.

9. The contact spring assembly according to claim 8, wherein said overspring arm has a base with a width having a center, and said perforation is formed approximately in said center of said width of said base.

10. The contact spring assembly according to claim 8, wherein said perforation is formed solely in said side wall.

11. The contact spring assembly according to claim 8, wherein said perforation is disposed in the vicinity of said longitudinal edges.

12. The contact spring assembly according to claim 11, wherein said perforation extends both partway into said respective side wall and partway into said bottom wall.

* * * * *